US006543223B2

(12) United States Patent
Muschong et al.

(10) Patent No.: US 6,543,223 B2
(45) Date of Patent: Apr. 8, 2003

(54) DRIVE DEVICE

(75) Inventors: Günther Muschong, Kernen (DE); Kurt Stoll, Esslingen (DE)

(73) Assignee: Festo AG & Co., Esslingen (DE)

( * ) Notice: Subject to any disclaimer, the term of this patent is extended or adjusted under 35 U.S.C. 154(b) by 0 days.

(21) Appl. No.: 09/808,438

(22) Filed: Mar. 14, 2001

(65) Prior Publication Data

US 2001/0022083 A1 Sep. 20, 2001

(30) Foreign Application Priority Data

Mar. 17, 2000 (DE) ..... 100 13 194

(51) Int. Cl.[7] ..... F15B 7/10
(52) U.S. Cl. ..... 60/476; 91/420; 91/454
(58) Field of Search ..... 60/476, 431, 432; 91/454, 446, 420

(56) References Cited

U.S. PATENT DOCUMENTS

| | | | | |
|---|---|---|---|---|
| 3,593,522 A | * | 7/1971 | Angert et al. | 60/433 |
| 4,696,163 A | * | 9/1987 | Glomeau | 60/476 |
| 5,125,324 A | | 6/1992 | Araki et al. | 91/454 |
| 6,092,290 A | * | 7/2000 | Vogelsanger | 30/228 |

FOREIGN PATENT DOCUMENTS

| | | | |
|---|---|---|---|
| DE | 1776139 | | 9/1971 |
| DE | 2929442 | A1 | 1/1981 |
| DE | 3637404 | A1 | 11/1987 |
| DE | 4137103 | A1 | 5/1993 |
| DE | 4207764 | A1 | 9/1993 |
| DE | 4302889 | A1 | 8/1994 |
| DE | 19535691 | C1 | 1/1997 |
| DE | 29903281 | U1 | 8/1999 |
| FR | 2752446 | | 2/1998 |
| JP | 09166101 | A * | 6/1997 |
| JP | 09170601 | | 6/1997 |

* cited by examiner

*Primary Examiner*—Edward K. Look
*Assistant Examiner*—Thomas E. Lazo
(74) *Attorney, Agent, or Firm*—Hoffmann & Baron, LLP

(57) ABSTRACT

A drive device comprising a closed hydraulic circuit which has a hydraulic drive adapted to be actuated by hydraulic medium and has a hydraulic pump responsible for the supply and removal of the hydraulic medium to and from the hydraulic drive. For the operation of the hydraulic pump an electric motor is provided. The activation of the hydraulic drive is controlled by the operational state of the hydraulic pump.

35 Claims, 2 Drawing Sheets

DRIVE DEVICE

BACKGROUND OF THE INVENTION

The invention relates to the drive device art and more specifically to drive devices having a drive to be activated by the supply of energy and which deliver drive power.

THE PRIOR ART.

Such a drive device is for example disclosed in the German utility model 29,903,825.4, where it is described as a component of a toggle clamping device. It comprises a pneumatic drive able to be operated by compressed air with its associated electrically actuated control valves in order to set the direction of driving of the pneumatic drive. As an alternative a hydraulic drive would be possible as well which is connected with electrically actuated servo valves in order to influence the state of the drive. While in the case of pneumatic drives design must be generally technically complex owing to the compressibility of the operating medium if accuracy of positioning and slow motion are to be possible, with hydraulic drives the principal problem is that of leakage and the large amount of upkeep work needed to ensure reliable hose connections and maintaining a high quality hydraulic medium in the system.

In the holding device sector designs with an electrical drive are therefore utilized as an alternative as well, a so-called "electrical clamp" being described by the company Tünkers Maschinenbau GmbH, whose electrical drive is in the form of a lead screw drive. However there is still a substantial wear problem here, more particularly when transmitting heavy setting forces.

SHORT SUMMARY OF THE INVENTION

One object of the invention is to create a drive device with which high drive forces may be transmitted while reducing the rate of wear and the need for servicing.

In order to achieve these and/or other objects appearing from the present specification, claims and drawings, in the present invention a drive device comprises a closed hydraulic circuit which includes a hydraulic drive able to be actuated by a hydraulic medium and a hydraulic pump causing supply and removal of the hydraulic medium to and from the hydraulic drive, an electric motor being provided for operation of the hydraulic pump and the actuation of the hydraulic drive is set by the operational state of the hydraulic pump.

It is in this manner that an electro-hydraulic drive device is created, in which owing to a closed hydraulic circuit the leakage problem may be extremely readily gotten under control and the special control by the electric motor activated hydraulic pump means that no expensive servo valves are required to operate the hydraulic drive in the desired manner. Dispensing with servo valves does in this respect offer the advantage as well that there are only relatively modest requirements for servicing of the hydraulic medium, this meaning that servicing of the equipment is extremely economic. The activation of the hydraulic drive is preferably only made dependent on the operational state of the hydraulic pump and may for example be controlled in a vary simple manner for instance by switching on and off and presetting a certain speed of rotation of the pump.

Further advantageous developments of the invention are defined in the claims. Different actuating pressures required during operation of the hydraulic drive may be conveniently preset in a manner dependent on the speed of rotation of the hydraulic pump. Thus loads can be accelerated or retarded without having to have recourse to an intermediately placed servo valve means, which influences the flow cross section. In this respect use is preferably made of suitable setting means, which may be controlled or regulated by way of a variable preset of the speed of rotation of the electric motor determining the hydraulic pump's speed of rotation. A possibility may also be provided for setting speed of rotation change functions in order to fashion the acceleration and retardation of a load to the moved by the hydraulic drive in a smooth manner and to avoid jerky motion.

In keeping with a particularly preferred form of the drive device the hydraulic drive is provided with at least one drive piston coupled in a driving manner with a power or force output part, which divides two working chambers from one another in a fluid-tight manner, which are respectively connected by way of a hydraulic circuit with the hydraulic pump, the supply of hydraulic fluid into the respective working chamber being accompanied by the simultaneous flow of hydraulic fluid from the other working chamber in order to displace the drive piston in the desired manner. Since the hydraulic pump is able to be rotated clockwise or counter-clockwise, for instance by changing the direction of rotation of the electric motor or by the use of an intermediate transmission, it is possible for hydraulic medium to be supplied into the one or the other of the two working chambers in order to influence the direction of motion of the drive piston accordingly.

The two hydraulic circuits of the drive device preferably contain a respective overridable check valve, which normally permits fluid flow from the hydraulic pump to the hydraulic drive and prevents it in the opposite direction, each check valve being able to be overridden by the pressure maintained in the respectively other hydraulic circuit by the hydraulic pump in order to render possible fluid flow from the hydraulic drive back to the hydraulic pump. It is in this manner that any desired intermediate positions of the drive piston may be maintained without the constant supply of energy, because the hydraulic medium is trapped by the check valves in the working chambers when the hydraulic pump is not activated. If on the contrary the hydraulic pump is activated, the pressure then established in the one hydraulic circuit overrides the check valve, located in the other hydraulic circuit and accordingly renders possible free movement of the working piston.

A further particularly advantageous design of the drive device is one in which at least one and preferably both hydraulic circuits contain a biasing valve, which normally shuts off the fluid connection from the associated working chamber to the hydraulic pump and only opens it, when and as long as a predetermined opening pressure is established. Thus the biasing valve is responsible for biasing of the hydraulic medium located in the output working chamber, which medium can not be immediately displaced, when there is an increase in pressure in the input chamber. It is only when the increase in pressure in the input working chamber is so strong that the pressure building up in the output working chamber reaches the minimum pressure, termed the opening pressure, that the previously entering hydraulic medium may leave. Since the pressure obtaining in the output working chamber then however produces a constant opposing opposite force to the desired direction of movement of the drive piston, the drive piston may be extremely quickly and accurately retarded even in the case of a very dynamic movement simply by varying the operational state of the hydraulic pump to change the pressure applied on the input side. Therefore even without servo controlled hydraulic valves extremely exact positioning of the drive piston or, respectively, of a force or power output connection member coupled therewith can be achieved even at high speeds of operation.

The design of the pilot valves is preferably such that the opening pressure responsible for opening is between 10% and 90% of the maximum possible operational pressure produced by the hydraulic pump. The preferred pressure range is in this respect between 30% and 50% of the above mentioned maximum actuating pressure. In a manner different than a simple check valve, which opens even at extremely low pressure differentials, the biasing valves are responsible for substantial biasing effect. In this case the opening pressure may be conveniently predetermined with a certain range of variation by suitable adjusting means in order to be able to perform simple adjustment to suit a specific case of application.

It is convenient for the respective biasing valve to comprise a moving shut off valve member, which is biased by spring force corresponding to the desired opening pressure into a closed position interrupting the fluid path and which is acted upon by the hydraulic fluid of the output working chamber opposing the spring force in the opening direction. If the pressure in the output working chamber increases to at least the opening pressure, there will be a resulting opening force able to overcome the spring force and switch over valve member into an open position thereof. The biasing valve consequently preferably possesses an inherent digital switching characteristic or behavior.

If a hydraulic circuit possesses both an overridable check valve and also a biasing valve, such valves will be preferably connected in series, the biasing valve preferably being located between the overridable check valve and the hydraulic drive.

Each biasing valve is preferably placed in parallel with a check valve adapted to open in the direction toward the hydraulic drive and to close in the opposite direction, the check valve rendering possible supply of the hydraulic medium into the associated working chamber, given the right direction of rotation of the hydraulic pump, bypassing the biasing valve.

For compensation of temperature variations and/or different volumes of the working chambers each hydraulic circuit may be connected with a hydraulic fluid equalizing container, which possesses a moving wall subject to the pressure of the atmosphere.

It is convenient for at least the hydraulic drive, the hydraulic pump, the hydraulic circuits and the electric motor to be arranged together as an assembly (drive unit) it being possible to exclusively use electrical interface means for power supply, such interface means serving for the operation of the electrical motor. It is possible to do without hydraulic interface means, because the closed hydraulic circuit may be designed in the form of a self-contained component of the drive unit.

In the case of a particularly advantageous design the drive device is designed in the form of a component of a clamping device, more especially a toggle clamping device, in which the force output part of the hydraulic drive is drivingly connected with a pivoting clamping arm of the clamping device. This design is to be more particularly recommended in conjunction with a drive device in the form of a single drive unit, since this form makes extremely compact dimensions and furthermore use as an alternative to a purely fluid power or purely electrically operated clamping device possible.

Further advantageous developments and convenient forms of the invention will be understood from the following detailed descriptive disclosure of one embodiment thereof in conjunction with the accompanying drawings.

LIST OF THE SEVERAL VIEWS OF THE FIGURES.

DESCRIPTION OF PREFERRED EMBODIMENTS OF THE INVENTION

Figure 2:
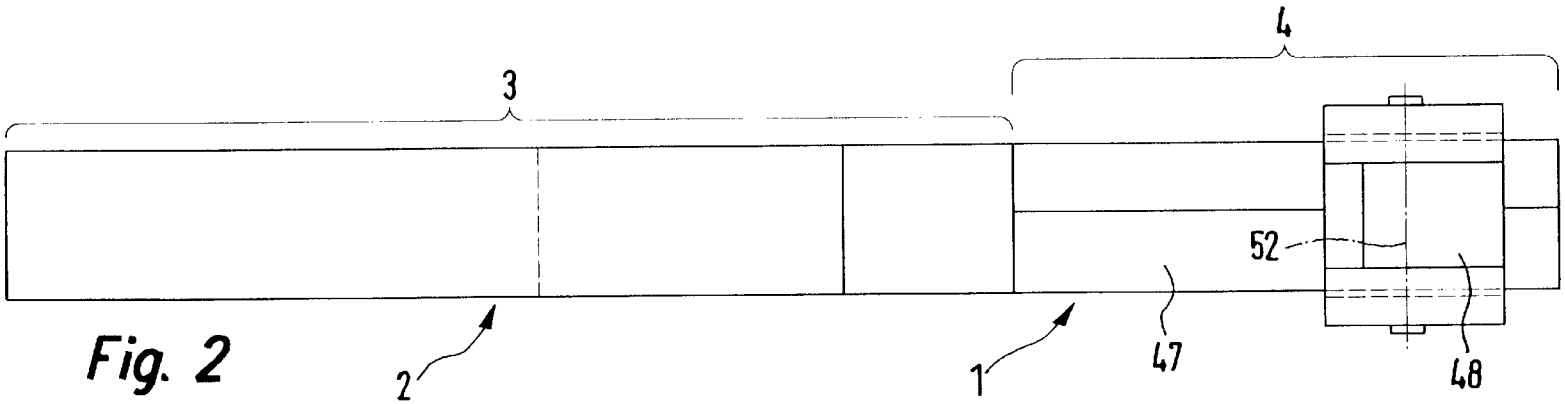
FIG. 2 shows the arrangement of FIG. 1 from the rear and looking in the direction of the arrow II.
Figure 1:
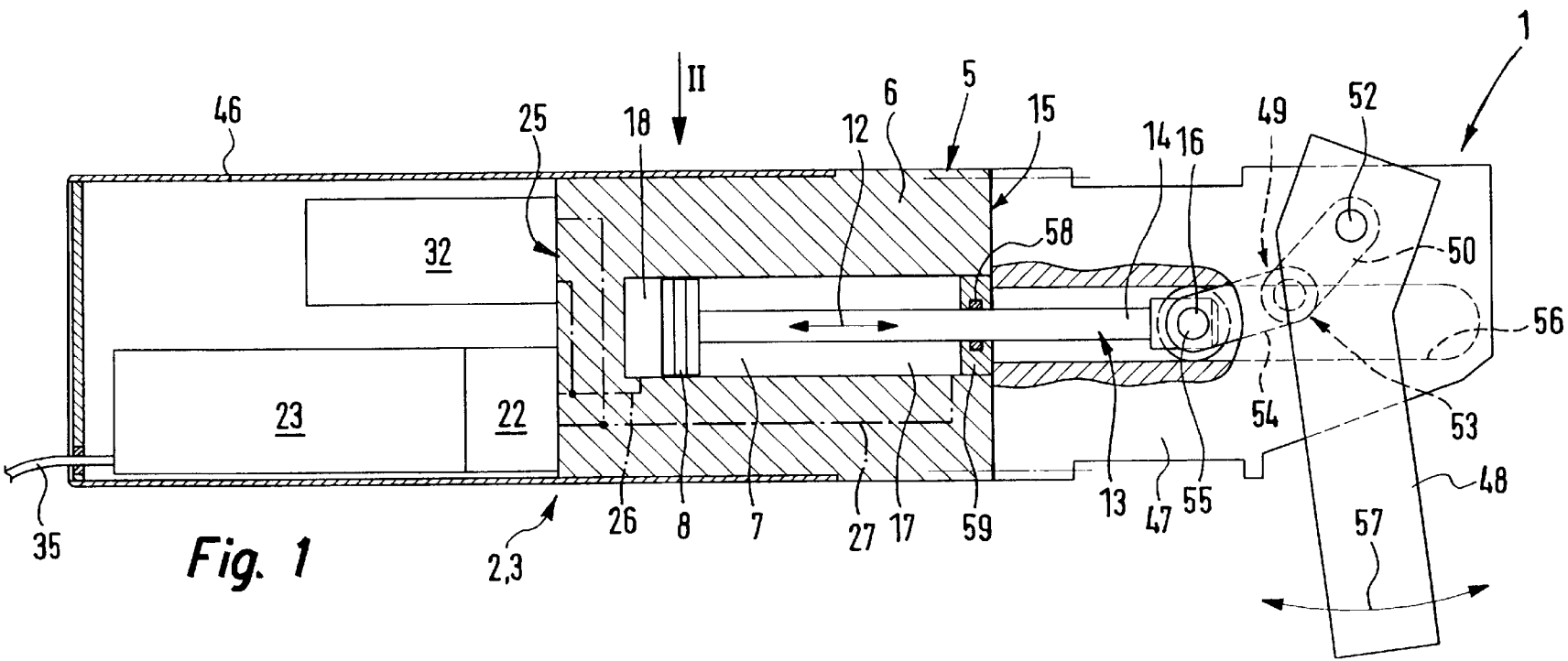
FIG. 1 is a diagrammatic elevation, partly in longitudinal section, of a clamping device, equipped with a preferred design of the drive device of the invention.
Figure 3:
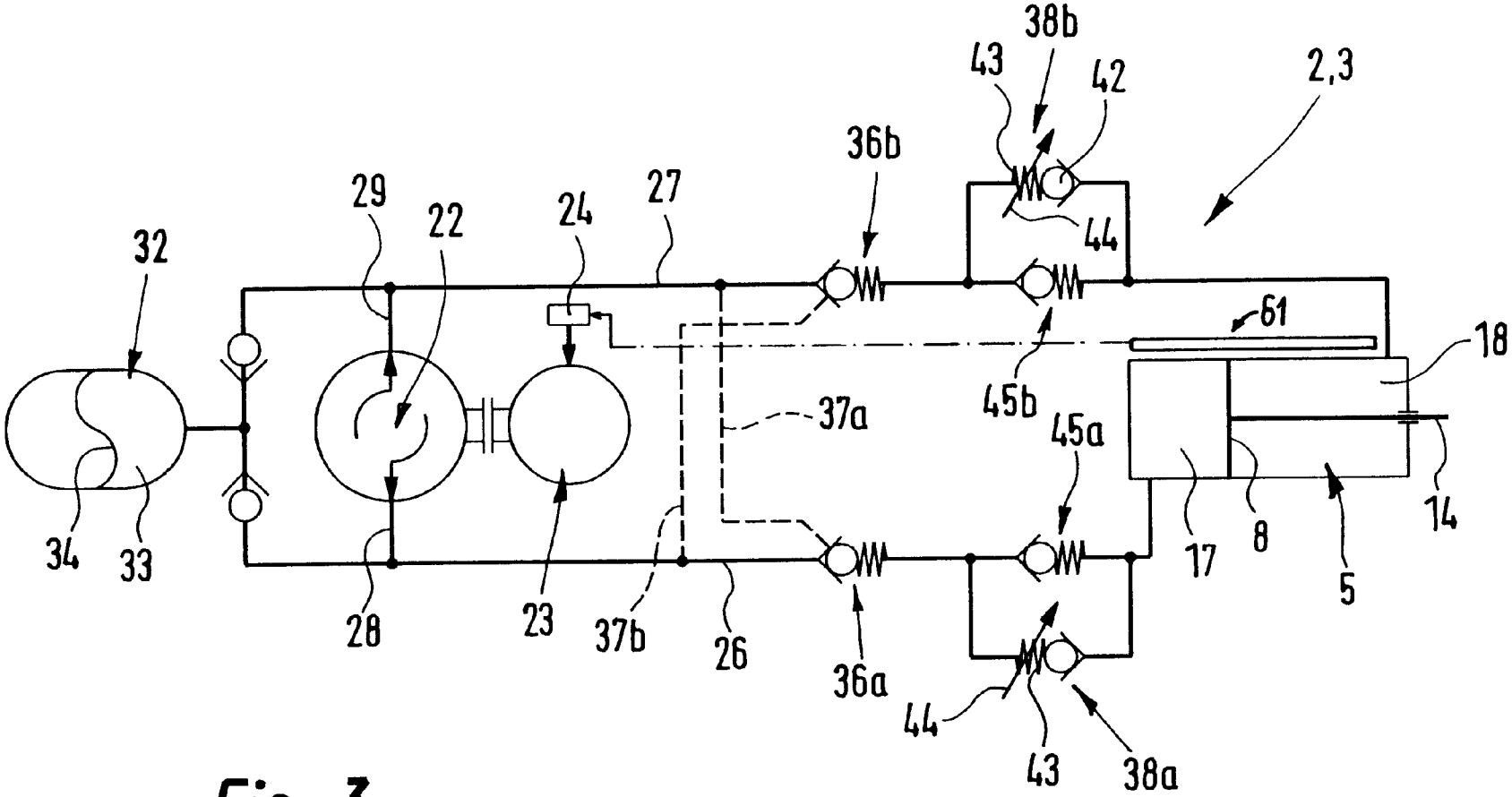
FIG. 3 is an electrical and hydraulic circuit diagram of the drive device preferably employed in the clamping device as illustrated in FIGS. 1 and 2.

FIGS. 1 and 2 depict a clamping device 1 operating on the toggle lever principle and whose principal components are a drive device 2 which can thus be termed a drive unit 3 in the form of an assembly and a clamping unit 4 permanently connected with the drive unit 3. The details of the circuitry of the drive device 2 and, respectively, of the drive unit 3 are only indicated diagrammatically in FIG. 1, whereas FIG. 3 is a more detailed circuit diagram of a particularly preferred design.

The drive device 2 comprises a hydraulic drive 5 adapted to be actuated by a hydraulic medium and which in the working example is designed in the form of a linear drive, but which in another field of application of the drive device 2 could be in the form of a rotary drive, for example.

The hydraulic drive 5 possesses a housing 6, in which an elongated piston receiving space 7 is located, same containing a drive piston 8. This piston 8 is a component of an output drive unit 13 able to slide in a driving movement 12 linearly as indicated by the double arrow, which output unit 13 in the working embodiment furthermore comprises an elongated power or force output part 14 constituted by a piston rod, such part 14 being permanently connected with the drive piston 8 and thus ganged therewith for motion as an integral structure.

The force output part 14 extends in the direction of the drive motion 12, it protruding at the front end 15 of the housing 6 and having force output means 16 on its section located outside the housing 6, such means 16 permitting a connection with components or means to be moved.

The drive piston 8 is located either directly in the housing 6 or in a sleeve inserted into the housing, the piston 8 dividing the piston receiving space 7 into two working chambers in a sealing manner, which in the following description will be referred to as the first and second working chambers 17 and 18 for convenience.

The drive device 2 furthermore includes a hydraulic pump 22of known design, which is connected in a driving manner with an electric motor 23 preferably in the form of a DC motor. The electric motor 23 may be rotated in either direction, clockwise or counter-clockwise, in order to selectively drive the hydraulic pump 22 in either of the two possible directions of rotation. The hydraulic pump is therefore reversible, it preferably being in the form of a volumetric flow pump, whose speed of rotation directly sets the speed of motion of the drive piston.

The electric motor 23 is equipped with setting means 24, with the aid of which the direction of the rotation and also the speed of rotation of the electric motor 23 may be set or predetermined in order to accordingly vary and set the speed of rotation of the hydraulic pump 22, such pump preferably being in the form of a rotary pump. Therefore, control or even regulation of the speed of rotation is possible.

Moreover the setting means 24 mean that if necessary speed functions (i.e. predetermined speed changes) may be so generated that a sudden acceleration or retardation of a load to be moved by the drive piston 8 is prevented.

It will be clear that the change in the direction of rotation of the pump may be effected by a transmission arranged intermediate the electric motor 23 and the hydraulic pump 23.

As shown in FIG. 1 the hydraulic pump 22 and the electric motor 23 are preferably made part of single assembly including the housing 6 of the hydraulic drive 5. In the working embodiment the hydraulic pump 22 is flange mounted on the housing 6, the electric motor 23 for its part being secured to the hydraulic pump 22. It would be possible furthermore to provide a separate attachment of the two components on the housing 6 and furthermore, alternatively, to have an at least partial integration of or both components in the housing 6.

In order to ensure that the drive unit 3 has a slim overall form the electric motor 23 and the hydraulic pump 22 are installed at the rear end 25 of the housing 6.

The hydraulic pump 22 is connected hydraulically by way of two mutually parallel hydraulic circuits, termed the first and the second circuit 26 and 27 for convenience, with the hydraulic drive 5. The hydraulic pump 22 possesses two pump connections 28 and 29, of which the first (28) is connected by way of the first hydraulic circuit 26 with the first working chamber 17 and of which the second (29) is connected by way of the second hydraulic circuit 27 with the second working chamber 18 of the hydraulic drive 5. In this respect there is then a closed, complete hydraulic circuit filled with hydraulic medium, such hydraulic medium being for example oil or water.

During operation of the hydraulic pump 22 the hydraulic medium is so pumped within the closed hydraulic circuit in a manner dependent on the direction of rotation, that it flows into the first or the second working chamber 17 or 18, hydraulic medium being simultaneously forced to flow back by the moving drive piston 8 from the respectively other working chamber 18 and 17 to the hydraulic pump 22. It is in this manner that the output drive unit 13 may be caused to perform a drive motion 12 in either of two opposite directions, the rod-like force output part 14 in the working embodiment moving either out of the housing 6 or moving into it. The important point is here that the activation of the hydraulic drive 5 and preferably furthermore the building up of pressure or respectively the volumetric flow in the activated hydraulic drive 5 is only set by the operating condition of the hydraulic pump. In order to halt the output drive unit 13 in a predetermined position, the hydraulic pump 22 is stopped. In order to move the output drive unit 13, dependent on the particular direction of motion required, the hydraulic pump 22 is operated with the respective direction of rotation. The building up of pressure in the working chamber on the supply side and accordingly also the speed of displacement of the drive unit 13 is set by the speed of rotation of the pump, same being able to be predetermined as desired with the aid of the setting means 24.

Preferably, consequently, the speed of the activated drive piston 8 of the hydraulic drive 5 is exclusively set by the volumetric flow of the hydraulic medium in the hydraulic circuits 26 and 27.

Due to the force output part 14, which extends through the second working chamber 18, on displacement of the output drive unit 13 different volumetric changes per unit time occur in the two working chambers 17 and 18. In order to allow or compensate for this, the two hydraulic circuits 26 and 27 are jointly connected with a hydraulic fluid.equalizing container 32, which accepts excess fluid and makes good any lack of hydraulic fluid. In this case the two hydraulic circuits 26 and 27 are connected for fluid flow with a variable volume equalizing space 33, which possesses a moving wall 34 subject to the pressure of the atmosphere on the other side thereof. Such wall may be constituted by a piston or by a diaphragm. As appears from FIG. 1, hydraulic fluid equalizing container 32 is preferably also a component of the drive unit 3 and can be integrated in the housing 6 or be secured to the rear end 25 thereof.

As regards the necessary supply of external energy or power for operation the drive device 2 is designed in the form of a monoenergetic instrumentality. Owing to the internally closed hydraulic circuit no supply and/or removal of hydraulic operating energy is necessary so that for energy or power supply the drive device 2 only has electrical connecting means 35 by way of which the electrical power required for operation of the electric motor 23 may be supplied. It is in this respect possible for it to be a question of plug connection means or, as in the working example, a flexible cable running to some source of electrical power.

In the form of a single assembly with the electrical connection means or by way of further separate electrical connection means it is possible furthermore to provide for incorporation of the drive means in an external electronic control means, which is also able to process position detection signal, which are generated in a manner dependent on the position of the output drive unit 13. The drive device 2 may in this manner be integrated in a manufacturing or assembly system, whose operating steps are electronically controlled.

The setting means 24 for predetermining the operating state of the hydraulic pump 22 may if necessary be placed at some point removed from the drive device 2 and cooperate with the electric motor 23 by way of suitable signal transmitting connections. All signals required for the operation of the drive device 2 can also be transmitted in a wireless manner.

It is preferred for the hydraulic drive 5 to be provided with a displacement measuring system 61, which can find the position of the drive piston 8 or of a component ganged for movement therewith to be able to control the electric motor 23 as required in a manner dependent on certain positions. In this respect the position finding signals can be supplied to the setting means 24 which in this case are preferably provided with a position regulator.

In the working embodiment the two hydraulic circuits 26 and 27 are contained in the housing 6 of the hydraulic drive 5, same being indicated in chained lines only in FIG. 1 diagrammatically, whereas their preferred design is indicated in FIG. 3 in detail.

Thus both hydraulic circuits preferably respectively include an overridable check valve 36*a* and 36*b*, that is to say a check valve, which under certain conditions may be overridden so that it renders possible passage of fluid in the direction which is normally shut off.

The overridable check valves 36*a* and 36*b* are so incorporated in the respective hydraulic circuit 26 and 27 that they normally allow fluid flow from the hydraulic pump 22 to the respectively connected working chamber 17 and 18 and prevent flow in the opposite direction. The overridable check valve 36*a* and 36*b* of a respective hydraulic circuit 26 and 27 is however connected for fluid flow by way of an override duct 37*a* and 37*b*, as indicated in chained lines in FIG. 3, with that duct section of the respectively other hydraulic circuit 27 and 26, which is located between the hydraulic pump 22 and the overridable check valve here. It is in this manner that a pressure maintained in the respective hydraulic circuit 26 and 27 by the hydraulic pump is tapped and supplied to the overridable check valve, located in the other hydraulic circuit, as an override signal. If therefore the hydraulic pump 22 is for instance so operated that pressure is built up in the first hydraulic circuit 26 and supply of the hydraulic fluid to the first working chamber 17 takes place through the overridable check valve 36*a*, which then opens, the pressure established will simultaneously cause overriding and opening of the overridable check valve 36*b* of the second hydraulic circuit 27 so that the hydraulic medium displaced from the second working chamber 18 may flow back to the hydraulic pump 22. Similar events take place in the case of the opposite direction of pumping by the hydraulic pump 22.

Owing to the overridable check valves 36*a* and 36*b* there is the advantage that the output drive unit 13 is arrested in its current position when the hydraulic pump 22 is out of operation, because the fluid in the working chambers 17 and 18 and in the adjoining hydraulic circuits 26 and 27 as far as the overridable check valves 36*a* and 36*b* in the hydraulic circuits 26 and 27 is completely held and not able to flow at all. Therefore to hold a predetermined position of the output drive unit 13 no energy is required.

The adoption of a further feature of the drive device 2 is to be recommended more particularly in cases of application, which require an extremely dynamic operation of the output drive unit 13, that is to say high acceleration and high speeds together with heavy retardation. This feature is the use of a biasing valve 38*a* and 38*b* preferably provided in each hydraulic circuit 26 and 27, which valve only opens the fluid connection from the associated working chamber 17 and 18 to the hydraulic pump 22 when and as long as in the working chamber 17 and 18, which happens to be on the output side, a predetermined minimum pressure has built up, which is termed the opening pressure. This opening pressure will typically be in a range of 10% and 90% and preferably of the order of 30% and 50% of the maximum operating pressure able to be generated by the hydraulic pump 22. In the working embodiment, where the working range of the hydraulic pump is between 24 and 100 bar, the two biasing valves 38*a* and 38*b* are designed for an opening pressure of approximately 50 bar.

The biasing valves 38*a* and 38*b*, which may be termed pressure limiting valves and which open in a pressure dependent manner, mean that the output drive unit 13 is subjected to a braking load in addition to the actual load to the moved, such braking or retarding load only having to be overcome by the production of a suitable pressure by the hydraulic pump 22 in order to cause movement of the output drive unit 13. If the external load to be addressed by the force output part 14 and the friction occurring are neglected, in the working example considered motion of the output drive unit 13 would only occur when a pressure of the supplied hydraulic medium over 50 bar is produced.

If the output drive unit 13 is shifted at a high speed owing to the building up of a corresponding pressure. the retarding operation may be extremely simply controlled by reduction of pumping rate, because the opening pressure due to the fluid biasing in the output working chamber results in an opposing force acting as a retarding force.

In the working embodiment the biasing valves respectively comprise a moving shut off member 42, which is biased by a spring force corresponding to the opening pressure, toward a closed position normally interrupting the fluid connection. The spring force is normally provided by a mechanical spring means 43 and/or a gas spring. Using setting means 44, which are only indicated diagrammatically, the spring bias may be set, preferably in a variable manner, in order to influence the opening pressure and accordingly to render possible an adaptation of the drive device 2 to a particular case of application in hand.

The shut off member 42 is acted upon by the hydraulic fluid in the output working chamber against the spring force in the opening direction and shifts the shut off member toward the opened position, if the setting force, resulting from the opening pressure, is larger than the spring force. The design is in this case preferably such that a digital switching behavior or characteristic is available and the biasing valve smartly switches over into the maximum, open position.

It will be clear that only one of the hydraulic circuits can be equipped with a biasing valve of the type described. This is more particularly the case when dynamic motion of the of the type described only occurs in one direction.

Because the biasing valves 38*a* and 38*b* in the respective hydraulic circuit 26 and 27 do not permit fluid flow from the hydraulic pump 22 to the hydraulic drive 5, they each have a check valve 45*a* and 45*b* connected in parallel with them, which in the said direction odes permit fluid flow and prevents flow in the opposite direction toward the hydraulic pump 22.

Within a respective hydraulic circuit 26 and 27 the overridable check valve 36*a* and 36*b* is connected in series with the parallel connected biasing and check valves 38*a* and 45*a*; 38*b* and 45*b*. Here the biasing valve 38*a* and 38*b* is preferably in that duct section that extends between the overridable check valve 36*a* and 36*b* and the hydraulic drive 5.

As initially mentioned the hydraulic drive 5, the hydraulic pump 22, the hydraulic circuits 26 and 27, the electric motor 23 and any hydraulic fluid equalizing container 32 are included as part of the drive unit 3. In this respect it is possible for components mounted on the rear side of the housing 6 to be covered by a protective casing 46 to prevent access of dirt and moisture.

It would also be feasible for the hydraulic drive 5, the equalizing or buffer container 32, the hydraulic pump 22, the electric motor 23 with its setting means 24 and furthermore the hydraulic circuits 26 and 27 to be integrated in a common housing.

The drive device 2 may be in principle employed any suitable purposes, different designs of the hydraulic drive 5 being conceivable, for instance as a piston rod-less structure. The employment of the drive device 2 in a combined structure as a single drive unit 3 in conjunction with a clamping device 1 is particularly advantageous, the front end face 15 of the housing 6 having the above mentioned clamping unit 4 mounted on it. The latter may, as illustrated, comprise a cross head 47 flange mounted on the housing 6, into which the end, projecting from the housing 6, of the output drive unit 13 extends and which bears a pivoting clamping arm 48. In this respect the force output means 16 of the output drive unit 13 are connected by way of a toggle mechanism 49 with the clamping arm 48 in such a manner that a rotary or pivoting movement of the clamping arm 48 may be derived from the linear motion of the output drive unit 13. In the working embodiment the clamping arm 48 has a pivoting lever 50 keyed on it, on which, at a bearing point clear of the pivot axis 52 of the clamping arm 48, a lug-like intermediate member 54 is pivoted, which by way of a further bearing means 55 articulates with the force or power output means 16.

In order to protect the force output part 14 and the seal 58 associated with it and placed adjacent to a front terminal wall 59 in the piston receiving against excessive wear, the outer terminal part of the output part 14 slides on guide means 56 in the longitudinal direction and at the same time is supported in the transverse direction in relation to the pivot axis. The guide means 56 may for example be constituted by one or more guide tracks, which are more particularly groove-like.

By actuation of the hydraulic drive 5 it is possible for the pivot arm 48 to be caused to move as indicated by the double arrow 57 in a pivoting movement about the pivot axis 52 to position it selectively in a clamping or a non clamping state. In the clamping setting it may act on a workpiece, not illustrated, to clamp it so firmly that same may be machined. The clamping device 1 is more especially suitable for use in conjunction with workpieces which are to be welded.

As may be seen from the rear view of FIG. 2, the drive unit 3 renders a particularly narrow overall form possible. It is more especially possible to so select the transverse dimensions of the drive unit 3 that same are the same as or less than those of the cross head 47.

Since the drive device 2 requires neither servo operated control or proportional valve nor choke valves, there are no particularly high standards to be met by the medium employed, something which reduces to a minimum the requirements for reconditioning or servicing it. Frequent changing of the hydraulic medium and cleaning filter means is therefore unnecessary. The direction of movement of the output drive unit 13 is only set by the direction of rotation of the DC motor, just as furthermore the stroke speed of the output drive unit 13 is a function of the speed of the DC motor or, respectively, the speed of rotation of the pump. The only variable during operation of the drive device 2 in the working example is the operational state of the hydraulic pump and, respectively, its speed of rotation.

It is again to be noted in connection with the working embodiment that it is a question of a drive device with a hydraulic drive 5 adapted to be actuated by a hydraulic medium and with which a hydraulic pump 22 is associated for the supply of the hydraulic medium. The build up of pressure in the activated hydraulic drive 5 is controlled by adjustable pressure limiting valves (biasing valves 38*a* and 38*b*), which are designed to open in a pressure dependent manner, and check valves 45*a* and 45*b* connected in parallel thereto. The speed of the drive piston 8 of the activated hydraulic drive 5 is exclusively set by the volumetric flow of the hydraulic medium in the hydraulic circuits 26 and 27.

What is claimed is:

1. A drive device comprising a closed hydraulic circuit, which includes a hydraulic drive able to be actuated by hydraulic medium and a hydraulic pump causing the supply and removal of such hydraulic medium in relation to the hydraulic drive, and furthermore an electric motor for operation of the hydraulic pump, activation of the hydraulic drive being dependent on the operational state of the hydraulic pump;

wherein said hydraulic drive includes at least one drive piston drivingly coupled with a force output part, said drive piston dividing two working chambers in a fluid tight manner from one another, said working chambers being connected by way of a respective hydraulic circuit with the hydraulic pump, the supply of hydraulic fluid to the one working chamber taking place with the simultaneous escape of hydraulic fluid from the other working chamber; and wherein said two hydraulic circuits comprise an overridable check valve, which normally allows flow of fluid from the hydraulic pump to the hydraulic drive and prevents flow in the opposite direction, each check valve being able to be overridden by a pressure maintained in the respectively other hydraulic circuit by the hydraulic pump in order to render possible fluid flow from the hydraulic drive back to the hydraulic pump.

2. The drive device as set forth in claim 1, comprising means to ensure a build up of different actuating pressures in the hydraulic drive in a manner solely dependent of the speed of rotation of the hydraulic pump.

3. The drive device as set forth in claim 1, comprising setting means for a preset value of the speed of rotation of the motor which sets the speed of rotation of the hydraulic pump.

4. The drive device as set forth in claim 3, wherein said setting means are adapted to generate a speed of rotation change function, which causes a regular drive movement of the hydraulic drive.

5. The drive device as set forth in claim 3, comprising a displacement measuring system associated with the hydraulic drive and whose signal is supplied to the setting means, said setting means preferably including a position regulator means.

6. The drive device as set forth in claim 1, wherein said electric motor is designed in the form of a drive motor with a controlled or regulated speed of rotation.

7. The drive device as set forth in claim 1, compromising means to cause the speed of motion of a drive piston of the hydraulic drive to be dependent of a speed of rotation of the hydraulic pump.

8. The drive device as set forth in claim 1, wherein said hydraulic pump is designed in the form of a reversible volumetric flow pump.

9. The drive device as set forth in claim 1, wherein said hydraulic pump is able to be driven selectively clockwise or counter-clockwise in order to supply hydraulic medium selectively to the one or to the other worker chamber and accordingly to set the direction of movement of the drive piston.

10. The drive device as set forth in claim 1, wherein at least one hydraulic circuit comprises a biasing valve, which only opens up the fluid connection from the respective working chamber to the hydraulic pump when and as long as a predetermined opening pressure obtains in the output working chamber.

11. The drive device as set forth in claim 10, wherein said biasing valve is actuated when the opening pressure is in a range between 10% and 90% of the maximum operational pressure able to be produced by the hydraulic pump.

12. The drive device as set forth in claim 10, comprising setting means for setting an adjustable leading value for the opening pressure.

13. The drive device as set forth in claim 10, wherein the biasing valve comprises a moving shut off member, which is biased by a spring force equal to the opening pressure toward a closed position interrupting the fluid connection and which is acted upon by the hydraulic fluid in the output working chamber against the spring force in the opening direction.

14. The drive device as set forth in claim 10, wherein each hydraulic circuit comprises a biasing valve.

15. The drive device as set forth in claim 10, wherein said two hydraulic circuits comprise an overridable check valve, which normally allows flow of fluid from the hydraulic pump to the hydraulic drive and prevents flow in the opposite direction, each check valve being able to be overridden by a pressure maintained in the respectively other hydraulic circuit by the hydraulic pump in order to render possible fluid flow from the hydraulic drive back to the hydraulic pump and wherein in a relevant hydraulic circuit the overridable check valve and the biasing valve are connected in series.

16. The drive device as set forth in claim 10, wherein a check valve adapted to open toward the hydraulic drive and to close in the opposite direction is connected in parallel to each biasing valve.

17. The drive device as set forth in claim 10, wherein said biasing valve is activated when the opening pressure is in a range between 30% and 50% of the maximum operational pressure able to be produced by the hydraulic pump.

18. The drive device as set forth in claim 1, wherein each hydraulic circuit is connected with a hydraulic fluid equalizing container.

19. The drive device as set forth in claim 1, wherein at least the hydraulic drive, the hydraulic pump, any hydraulic circuits present and the electric motor are joined together as a single assembly.

20. The drive device as set forth in claim 19, wherein for the supply of power the drive unit has exclusively electrical connection means.

21. The drive device as set forth in claim 1 as a component of clamping device, more particularly in the form of a toggle clamping device, the force output part of the hydraulic drive being connected with a pivoting clamping arm in a driving manner.

22. The drive device as set forth in claim 21 wherein for the supply of power the drive unit has exclusively electrical connection means and wherein a cross head is arranged on the drive unit and bears the pivot arm.

23. The drive device as set forth in claim 22 wherein the cross sectional dimensions of the drive unit are equal to or smaller than those of the cross head.

24. The drive device as set forth in claim 1 wherein the hydraulic drive is a rotary drive.

25. The drive device as set forth in claim 1 wherein the hydraulic drive is a linear drive.

26. A drive device having at least one closed hydraulic circuit, said at least one closed hydraulic circuit comprising:

a hydraulic drive able to be actuated by a hydraulic medium;

a hydraulic pump causing the supply and removal of such hydraulic medium in relation to the hydraulic drive;

wherein said hydraulic drive includes at least one drive piston drivingly coupled with a force output part, said drive piston dividing two working chambers in a fluid tight manner from one another, said working chambers being connected by way of a respective hydraulic circuit with the hydraulic pump, the supply of hydraulic fluid to the one working chamber taking place with the simultaneous escape of hydraulic fluid from the other working chamber;

an electric motor for operation of the hydraulic pump, activation of the hydraulic drive being dependent on the operational state of the hydraulic pump;

a biasing valve which only opens up the fluid connection from the respective working chamber to the hydraulic pump when and as long as a predetermined opening pressure obtains in the output working chamber; and a setting means for setting an adjustable leading value for the opening pressure.

27. A drive device having at least one closed hydraulic circuit, said at least one closed hydraulic circuit comprising:

a hydraulic drive able to be actuated by a hydraulic medium;

a hydraulic pump causing the supply and removal of such hydraulic medium in relation to the hydraulic drive;

wherein said hydraulic drive includes at least one drive piston drivingly coupled with a force output part, said drive piston dividing two working chambers in a fluid tight manner from one another, said working chambers being connected by way of a respective hydraulic circuit with the hydraulic pump, the supply of hydraulic fluid to the one working chamber taking place with the simultaneous escape of hydraulic fluid from the other working chamber;

an electric motor for operation of the hydraulic pump, activation of the hydraulic drive being dependent on the operational state of the hydraulic pump;

a biasing valve which only opens up the fluid connection from the respective working chamber to the hydraulic pump when and as long as a predetermined opening pressure obtains in the output working chamber; and wherein said two hydraulic circuits comprise an overridable check valve, which normally allows flow of fluid from the hydraulic pump to the hydraulic drive and prevents flow in the opposite direction, each check valve being able to be overridden by a pressure maintained in the respectively other hydraulic circuit by the hydraulic pump in order to render possible fluid flow from the hydraulic drive, back to the hydraulic pump and wherein a relevant hydraulic circuit the overridable check valve, and the biasing valve are connected in series.

28. The drive device as set forth in claim 27, wherein said biasing valve is actuated when the opening pressure is in the range between 10% and 90% of the maximum operational pressure able to be produced by the hydraulic pump.

29. The drive device as set forth in claim 27, wherein the hydraulic drive is a rotary drive.

30. The drive device as set forth in claim 27, wherein the hydraulic drive is a linear drive.

31. A drive device having at least one closed hydraulic circuit, said at least one closed hydraulic circuit comprising:

a hydraulic drive able to be actuated by a hydraulic medium; a hydraulic pump causing the supply and removal of such hydraulic medium in relation to the hydraulic drive;

wherein said hydraulic drive includes at least one drive piston drivingly coupled with a force output part, said drive piston dividing two working chambers in a fluid tight manner from one another, said working chambers being connected by way of a respective hydraulic circuit with the hydraulic pump, the supply of hydraulic fluid to the one working chamber taking place with the simultaneous escape of hydraulic fluid from the other working chamber;

an electric motor for operation of the hydraulic pump, activation of the hydraulic drive being dependent on the operational state of the hydraulic pump;

a adjustable biasing valve which only opens up the fluid connection from the respective working chamber to the hydraulic pump when and as long as a predetermined opening pressure obtains in the output working chamber; and wherein a check valve adapted to open toward the hydraulic drive and to close in the opposite direction is connected in parallel to each biasing valve.

32. A drive device having at least one closed hydraulic circuit, said at least one closed hydraulic circuit comprising:

a hydraulic drive able to be actuated by a hydraulic medium;

a hydraulic pump causing the supply and removal of such hydraulic medium in relation to the hydraulic drive;

wherein said hydraulic drive includes at least one drive piston drivingly coupled with a force output part, said drive piston dividing two working chambers in a fluid tight manner from one another, said working chambers being connected by way of a respective hydraulic circuit with the hydraulic pump, the supply of hydraulic fluid to the one working chamber taking place with the simultaneous escape of hydraulic fluid from the other working chamber;

an electric motor for operation of the hydraulic pump, activation of the hydraulic drive being dependent on the operational state of the hydraulic pump, a biasing valve which only opens up the fluid connection from the respective working chamber to the hydraulic pump when and as long as a predetermined opening pressure obtains in the output working chamber; and a setting means for setting an adjustable leading value for the opening pressure; and a pivoting clamping arm, wherein a force output part is connecting to said clamping arm and moves said clamping arm in a driving manner to form a toggle clamping device.

33. The drive device as set forth in claim 32 as a component of clamping device, more particularly in the form of a toggle clamping device, the force output part of the hydraulic drive being connected with a pivoting clamping arm in a driving manner.

34. The drive device as set forth in claim 33 wherein for the supply of power the drive unit has exclusively electrical connection means and wherein a cross head is arranged on the drive unit and bears the pivot arm.

35. The drive device as set forth in claim 33 wherein the cross sectional dimensions of the drive unit are equal to or smaller than those of the cross head.

* * * * *